US007510100B2

(12) United States Patent
Stradella et al.

(10) Patent No.: US 7,510,100 B2
(45) Date of Patent: Mar. 31, 2009

(54) DOSE INDICATOR FOR A FLUID DISPENSER DEVICE

(75) Inventors: Fabio Stradella, Camogli (IT); Giuseppe Stradella, Camogli (IT)

(73) Assignee: Valois S.A.S., Le Neubourg (FR)

( * ) Notice: Subject to any disclaimer, the term of this patent is extended or adjusted under 35 U.S.C. 154(b) by 623 days.

(21) Appl. No.: 10/567,353

(22) PCT Filed: Jul. 27, 2004

(86) PCT No.: PCT/FR2004/002007

§ 371 (c)(1),
(2), (4) Date: Feb. 6, 2006

(87) PCT Pub. No.: WO2005/020138

PCT Pub. Date: Mar. 3, 2005

(65) Prior Publication Data

US 2007/0194041 A1 Aug. 23, 2007

(30) Foreign Application Priority Data

Aug. 12, 2003 (FR) ..... 03 09886

(51) Int. Cl.
*B67D 5/22* (2006.01)

(52) U.S. Cl. ..... 222/36; 128/205.23

(58) Field of Classification Search ..... 222/36, 222/38, 23, 45–49; 128/205.23, 200.13, 128/200.14, 200.18, 200.24, 203.12, 203.15, 128/203.22; 116/309–319, 284, 285, 270–272, 116/321–324

See application file for complete search history.

(56) References Cited

U.S. PATENT DOCUMENTS

| | | | | |
|---|---|---|---|---|
| 2,875,950 | A | 3/1959 | Mast et al. | |
| 5,687,710 | A * | 11/1997 | Ambrosio et al. | 128/203.15 |
| 5,988,496 | A * | 11/1999 | Bruna | 235/91 R |
| 6,065,471 | A * | 5/2000 | Schaeffer et al. | 128/203.15 |
| 6,161,724 | A * | 12/2000 | Blacker et al. | 222/23 |
| 6,164,494 | A * | 12/2000 | Marelli | 222/38 |
| 6,234,168 | B1 * | 5/2001 | Bruna | 128/203.12 |

(Continued)

FOREIGN PATENT DOCUMENTS

DE 100 61 723 A1 7/2002

(Continued)

*Primary Examiner*—Lien T Ngo
(74) *Attorney, Agent, or Firm*—Sughrue Mion, PLLC

(57) ABSTRACT

A dose indicator for a fluid dispenser device, said indicator comprising: a body (4); an actuator (1) that is mounted to turn relative to said body (4) about a first axis, and including drive means (14, 15); and a cylindrical indicator element (2) that is mounted to turn relative to said body (4) about a second axis and including a set of teeth (21) that co-operate with said drive means (14, 15) of said actuator (1) so as to turn each time the dispenser device is actuated, said indicator element (2) further including numeric and/or symbolic indicator means (25) so as to indicate to the user the number of doses that have been dispensed or that remain to be dispensed from said dispenser device; said actuator (1) co-operating with actuator means (7) secured to said body (4), said actuator means (7) being displaced in translation each time the dispenser device is actuated, and co-operating with said actuator (1) so as to transform the translation of said actuator means (7) into said actuator (1) turning.

21 Claims, 3 Drawing Sheets

U.S. PATENT DOCUMENTS

| | | | | |
|---|---|---|---|---|
| 6,321,747 | B1 * | 11/2001 | Dmitrovic et al. | 128/203.15 |
| 6,328,037 | B1 * | 12/2001 | Scarrott et al. | 128/205.23 |
| 7,156,258 | B2 * | 1/2007 | Eckert | 222/23 |
| 7,195,134 | B2 * | 3/2007 | Ouyang et al. | 222/36 |
| 7,448,342 | B2 * | 11/2008 | Von Schuckmann | 116/307 |
| 2002/0189611 | A1 | 12/2002 | Greenwood et al. | |
| 2004/0250812 | A1 * | 12/2004 | Davies et al. | 128/200.14 |
| 2006/0278225 | A1 * | 12/2006 | MacMichael et al. | 128/205.16 |

FOREIGN PATENT DOCUMENTS

| | | | |
|---|---|---|---|
| FR | 2 750 780 | A | 1/1998 |

* cited by examiner

DOSE INDICATOR FOR A FLUID DISPENSER DEVICE

The present invention relates to a dose indicator, and to a fluid dispenser device including such an indicator.

Dose indicators or counters are well known for fluid dispenser devices, and in particular dispensers of pharmaceuticals, or cosmetics, or dispensers in the field of perfumery. They can be associated with devices having a pump or with devices having a valve, in which the fluid is dispensed by means of a propellant gas. An important requirement, in particular for medicine dispensers, is to avoid any risk of under-counting. To achieve this, it is necessary to count the dispensing of the dose at the start of the actuation stroke of the pump or the valve, in particular so as ensure that, in the event of partial actuation, even a partially dispensed dose is counted by the counter. Another requirement is to make a counter having as few component parts as possible, thereby making the manufacture and assembly of said counter less complicated and thus less costly, and thereby reducing the risks of the counter malfunctioning. In addition, it is often desirable to have a counter that is capable of counting a large number of doses, e.g. one hundred and twenty or two hundred doses, without having to make an extremely complex counter and without having dimensions that are too large.

An object of the present invention is to provide a novel dose indicator for a fluid dispenser device that fulfils, effectively, all of the above-mentioned requirements.

In particular, an object of the present invention is to provide a dose indicator that makes it possible to count a dose at the start of each actuation stroke of the pump or of the valve of the device, while also operating reliably.

Another object of the present invention is to provide a dose indicator that has as few component parts as possible.

Another object of the present invention is to provide a dose indicator that is simple and inexpensive to manufacture and to assemble.

Another object of the present invention is to provide a dose indicator that makes it possible to count a large number of doses.

The present invention thus provides a dose indicator for a fluid dispenser device, said indicator comprising: a body; an actuator that is mounted to turn relative to said body about a first axis, and including drive means; and a cylindrical indicator element that is mounted to turn relative to said body about a second axis and including a set of teeth that co-operate with said drive means of said actuator so as to turn each time the dispenser device is actuated, said indicator element further including numeric and/or symbolic indicator means so as to indicate to the user the number of doses that have been dispensed or that remain to be dispensed from said dispenser device; said actuator co-operating with actuator means secured to said body, said actuator means being displaced in translation each time the dispenser device is actuated, and co-operating with said actuator so as to transform the translation of said actuator means into said actuator turning.

Advantageously, said indicator element is disposed around said actuator, said set of teeth being formed on the inside peripheral wall of said indicator element.

Advantageously, said first and second axes are identical.

Advantageously, a cover element, secured to said body, is disposed around said indicator element, said cover element including a window in order to see said indicator means of said indicator element.

Advantageously, one amongst the indicator element and the cover element includes guide means that co-operate with complementary guide means provided on the other element.

Advantageously, said guide means comprise at least one guide groove, and said complementary guide means comprise at least one guide projection.

Advantageously, said guide groove, which may in particular be helical, winds around said indicator element in a plurality of turns, or alternatively around said cover element, enabling the indicator to count a number of doses that is greater than the number of teeth provided in the set of teeth of the indicator element.

Advantageously, one amongst the actuator and the actuator means includes at least one actuator member that is at least partially oblique relative to the direction of displacement in translation of said actuator means, said at least one actuator member co-operating with at least one complementary actuator member provided on the other one amongst the actuator and the actuator means, so that a displacement in translation of the actuator means is transformed into said actuator turning.

Advantageously, said at least one actuator member is an actuator groove, and said at least one complementary actuator member is an actuator projection.

Advantageously, said drive means of the actuator comprise a flexible tab supporting a drive projection that co-operates with the teeth of the set of teeth of the indicator element.

Advantageously, said flexible tab comprises a first flexible tab portion, and a second flexible tab portion, the first flexible tab portion supporting the drive projection, and the second flexible tab portion connecting said first flexible tab to said actuator.

Advantageously, in order to ensure a count at each actuation, and in order to compensate for manufacturing tolerances, the angle through which the actuator turns is greater than the angle defined by a tooth in the set of teeth of the indicator element, the body including abutment means to prevent the indicator element from turning through more than one tooth in the set of teeth, the additional amount through which the actuator turns being compensated by the second flexible-tab portion of the drive means flexing.

Advantageously, said body includes a wall portion that is cylindrical, at least in part, and that is disposed between said actuator and said indicator element, said wall portion having a cut-out forming a passage for passing the drive means of the actuator to the set of teeth of the indicator element.

Advantageously, an edge of said cut-out forms said abutment means.

Advantageously, said body includes anti-return means for the indicator element, said anti-return means preventing said element from turning in the direction opposite to the direction imparted thereto by the actuator.

Advantageously, said anti-return means comprises a flexible tab including an anti-return projection that co-operates with said set of teeth.

Advantageously, resilient means are provided so as to urge said actuator towards its rest position while the actuator means are returning to their rest position.

Advantageously, said resilient means comprise at least one resilient blade that is secured to said actuator, said at least one resilient blade being elastically deformed while the device is being actuated.

The present invention also provides a fluid dispenser device comprising: a reservoir containing the fluid; a dispenser member, such as a pump or a valve; and a dispenser head incorporating a dispenser orifice, said device further comprising a dose indicator as described above.

Advantageously, the body is a portion of said head, said actuator means being secured to said head.

Advantageously, said actuator means are formed on an insert that is inserted into said head upstream from said dispenser orifice.

Other characteristics and advantages of the present invention appear more clearly from the following detailed description of two embodiments thereof, given by way of non-limiting example, and with reference to the accompanying drawings, and in which.

The invention is described below with reference to two embodiments, shown in FIGS. 1 and 2 respectively, but the present invention naturally has a much wider application, and applies to any type of fluid dispenser device.

Figure 1:
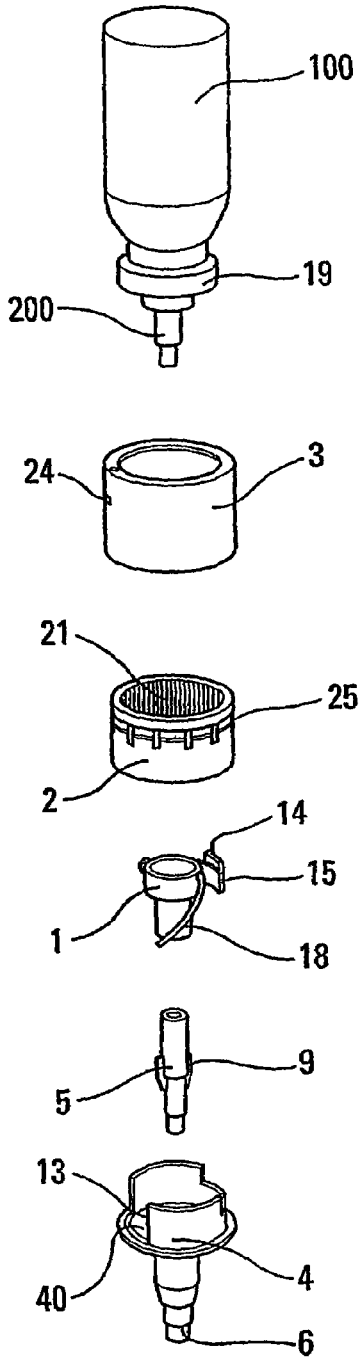
FIG. 1 is a diagrammatic exploded view in perspective of a fluid dispenser device constituting a first embodiment of the present invention.
Figure 10:
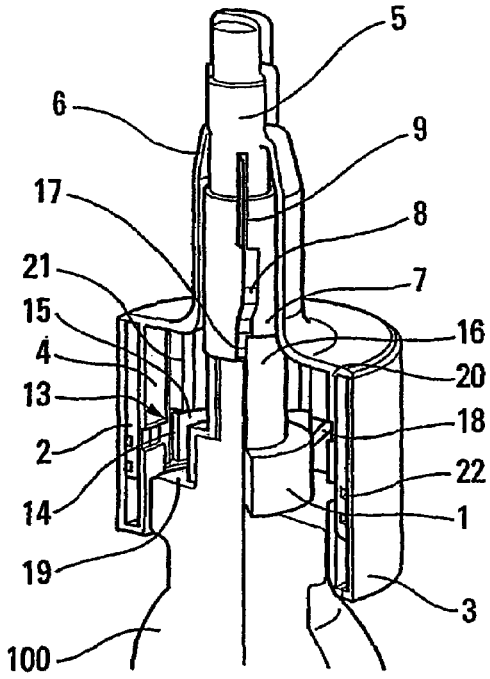
FIG. 10 is a diagrammatic and partially cut-away perspective view of a dispenser device incorporating an indicator constituting the first embodiment shown in FIG. 1.
Figure 11:
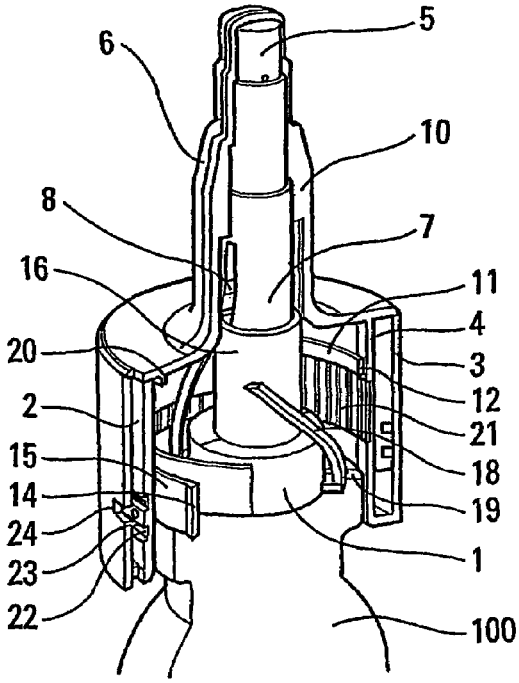
FIG. 11 is a view similar to the view in FIG. 10, but taken from another view point.

With reference more particularly to FIG. 1, the device includes a reservoir 100 on which there is mounted a dispenser member 200, such as a pump or a valve. In the embodiment in FIG. 1, the dispenser member is a pump 200 that can be fastened onto the reservoir, e.g. by means of a fastener ring 19. The device further includes a dispenser head 6 incorporating a dispenser orifice (not shown). The head 6 is axially displaceable relative to the pump 200 so as to actuate said pump and dispense the fluid contained in the reservoir 100. In the embodiment shown in FIG. 1, the dispenser head 6 is of the nasal type, but naturally any type of head is also applicable to the present invention. The head 6 includes a body 4 that is preferably made integrally as a single piece with the head, said body 4 being adapted to receive a dose indicator or counter, as described below. The dose counter or indicator includes an actuator 1 that is mounted to turn relative to said body 4 about a first axis. The axis of rotation preferably corresponds to the central axis of the device. As shown in FIGS. 10 and 11, said actuator 1 advantageously rests on the fastener ring 19, which prevents it from moving axially while the device is being actuated. A cylindrical indicator element 2 is also mounted to turn relative to the body 4 about a second axis. The second axis is preferably identical to the first axis of rotation of the actuator, and thus also preferably corresponds to the central axis of the device.

Figure 6:
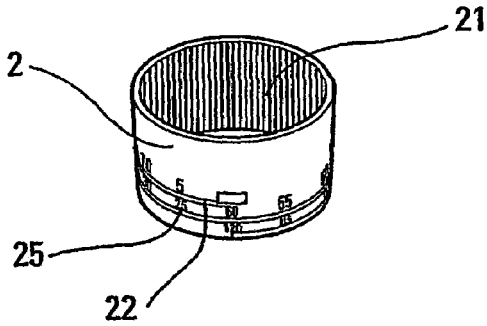
FIG. 6 is a diagrammatic perspective view of an indicator element constituting an advantageous embodiment of the present invention.
Figure 7:
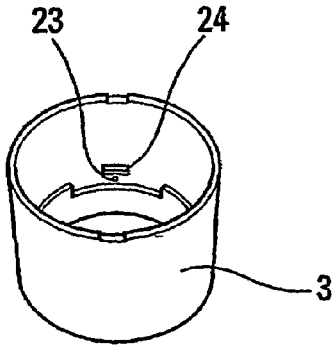
FIG. 7 is a diagrammatic perspective view of a cover element adapted to the first embodiment of the invention shown in FIG. 1.

The indicator element 2 includes a set of teeth 21 that co-operate with drive means 14, 15 of the actuator 1. As shown in FIGS. 1, 2, and 6, the set of teeth 21 is advantageously formed on the inside peripheral wall of the indicator element 2, said indicator element being disposed around the actuator 1. The drive means 14, 15 of the actuator 1 advantageously comprise a flexible tab 15 supporting a drive projection 14 that co-operates with the teeth of the set of teeth 21 of the indicator element 2, so as to cause the indicator element 2 to turn each time the actuator 1 is turned. The indicator element 2 supports indicator means 25, such as numbers or symbols, so as to enable the user to see the number of doses that have been dispensed or that remain to be dispensed from said dispenser device.

The indicator of the present invention operates as follows: The actuator 1 co-operates with actuator means 7 that are secured to the body 4 and that are displaced in translation each time the dispenser device is actuated. The displacement in translation of the actuator means 7 is transformed into said actuator turning, so that each time the device is actuated, the indicator element 2 is turned by means of the actuator 1, in order to count one dose.

Preferably, either the actuator 1 or the actuator means 7 include(s) one or more actuator members 8 that are each advantageously formed by an actuator groove 8. The other of said two elements includes one or more complementary actuator members 17 that are each advantageously formed by an actuator projection 17 co-operating with a respective said actuator groove 8. In the embodiments shown in the figures, the actuator means 7 include two diametrally opposite grooves 8, and the actuator 1 includes two diametrally opposite projections 17 sliding in said grooves 8. As shown in particular in FIG. 3, the grooves 8 are at least partially oblique relative to the displacement direction in translation of the actuator means 7. Thus, a displacement in translation of the actuator means 7 causes the actuator 1 to turn by means of said projections 17 which slide in said grooves, and which cause the actuator 1 to turn when the oblique portions of said grooves 8 reach them. By means of the flexible tab 15 and the drive projection 14, the actuator 1 thus also causes the indicator element to turn, in order to count one dose.

A cover element 3 is advantageously provided, disposed around the indicator element 2. The cover element 3 is preferably secured to the body 4 and includes a window 24 making it possible to see the indicator means 25 of the indicator element 2. As shown in particular in FIG. 6, the indicator element 2 can include guide means 22 that are advantageously formed by at least one guide groove 22. The guide means 22 co-operate with complementary guide means 23 that are advantageously formed by at least one guide projection 23 provided in the cover element 3. In a variant, it is possible to dispose the guide means 22 in the cover element 3, and the complementary guide means 23 on the indicator element 2. Preferably, the guide groove 22 is advantageously helical, and advantageously winds around the indicator element 2 in a plurality of turns, thereby enabling the indicator to count a number of doses that is greater than the number of teeth provided in the set of teeth 21 of the indicator element 2. In the embodiments shown, the indicator element 2 thus includes sixty teeth, and the guide groove 22, which in the embodiment in FIG. 6 winds around two turns, thus enables one hundred and twenty doses to be counted. In order to increase the number of doses that the indicator can count, it suffices to increase the number of teeth in the set of teeth 21 and/or increase the number of turns of the guide groove 22. It should be observed that the guide groove 22 is not necessarily helical, but could be formed by parallel circular portions that are connected to one another via oblique ramps. It is possible to provide fractions of circular and/or oblique turns that are connected together. Since the cover element 3 is stationary relative to the body 4, the indicator element 2 is thus turned and possibly displaced in translation relative to said cover element 3 as the projection 23 slides in the guide groove 22.

Figure 3:
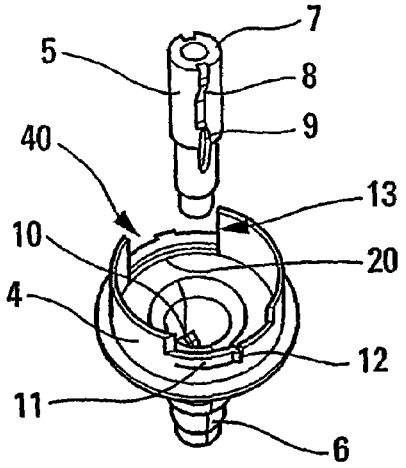
FIG. 3 is a diagrammatic perspective view of a portion of the FIG. 1 device.

As shown in FIGS. 1 and 3, the actuator means 7 can be secured to an insert 5 that is inserted into the head 6. In particular, the insert 5 serves to limit the dead volume of the fluid expulsion channel, and to form a spray at the dispenser orifice. In a variant, the actuator means 7 could be formed on a stationary portion of the head 6 or some other part. As shown in FIG. 3, the actuator groove 8 advantageously comprises an initial rectilinear portion that enables the device to be assembled, then an oblique portion that enables the dose to be counted, and finally another rectilinear portion that enables the actuation stroke of the device to be continued. Thus, by disposing the oblique portion right at the start of the actuation stroke of the device, a certain and reliable count is ensured from the start of the actuation stroke, thereby avoiding any risk of under-counting. When the actuator means 7 are formed on an insert 5, positioning fins 9 that co-operate with corresponding positioning grooves 10 in the head 6 are advantageously provided, so as to prevent any turning of said insert 5 relative to the head 6. The actuator means 7 are designed to exert a movement in translation only, and any turning of the actuator means should therefore be avoided.

Figure 5:
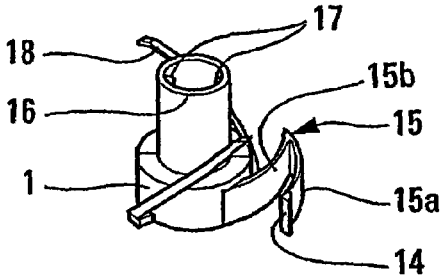
FIG. 5 is a diagrammatic perspective view of an actuator constituting an advantageous embodiment of the present invention.
Figure 9:
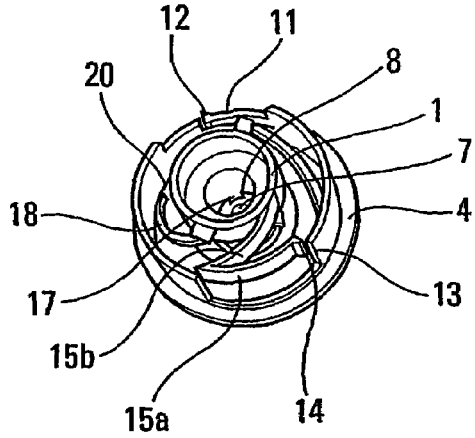
FIG. 9 is a diagrammatic perspective view of a portion of the indicator constituting an advantageous embodiment of the present invention.

The actuator 1 advantageously includes a sleeve 16 that surrounds the actuator means 7, as shown in FIGS. 10 and 11. During actuation, and thus during axial displacement of the dispenser head 6 relative to the receptacle 100, the unit formed by the head 6, the insert 5 (if it is provided), the indicator element 2, and the cover element 3 is axially displaced relative to the actuator 1 and the reservoir 100. The actuator 1 is held axially in position by resting on the fastener ring 19. The helical, or at least partially oblique, actuator grooves 8 cause the actuator 1 to turn by means of actuator projections 17 which slide in said actuator grooves 8 while the device is being actuated. In order to avoid any risk of under-counting, and in particular in order to compensate for manufacturing tolerances, the actuator grooves 8 are formed so as to turn through an angle that is greater than the angle formed by one tooth of the set of teeth 21. By way of example, and in the embodiments shown, the set of teeth comprises sixty teeth, so that each tooth defines an angle of 6°. Thus, it is preferably envisaged that the actuator 1 turns through more than 6°, e.g. 9° over the entire actuation stroke. This excess turning makes it possible to compensate for possible manufacturing tolerances, and guarantees one count at each actuation. Naturally, means are provided so as to prevent the indicator element 2 from turning through an angle corresponding to more than one tooth, i.e. from turning through more than 6°. The means advantageously comprise an abutment 13 formed on the body 4, and that co-operates with the flexible tab 15 of the actuator 1. More precisely, the flexible tab 15 can comprise a first flexible tab portion 15*a* and a second flexible tab portion 15*b*. As shown in FIG. 5, the first flexible-tab portion 15*a* supports the drive projection 14, whereas the second tab portion 15*b* connects the first tab portion 15*a* to the actuator 1. With reference to FIG. 9, the operation of the system can be seen more clearly. Thus, after having caused the indicator element 2 to turn through 6°, the drive projection 14 comes into abutment against the abutment 13 of the body 4. The excess turning of the actuator 1 is thus compensated by the second flexible-tab portion 15*b*, which can flex and thus enable the actuator 1 to continue to turn, while preventing the drive projection 14 and thus the indicator element 2 from turning. The abutment 13 is advantageously formed in the body 4 in a cut-out 40 provided in a wall portion that is cylindrical, at least in part, and that extends around the outside of the actuator 1, but inside the indicator element 2. In particular, the cut-out 40 provides a passage for passing the flexible tab 15 and its drive projection 14 to the set of teeth 21. In addition, the body 4 can also include anti-return means that can be formed by a flexible tab 11 supporting an anti-return projection 12 that also co-operates with said set of teeth 21. The anti-return means prevent any turning of the indicator element 2 in the direction opposite to the direction imparted thereto by the actuator 1.

After actuation, when the system returns to its rest position, the drive projection 14 can slide against the teeth of the set of teeth 21 by means of the first portion of the flexible tab 15*a* flexing. As explained above, the anti-return means provided on the body 4 ensure there is no risk of the indicator element being turned by this operation.

Advantageously, resilient means 18 are provided so as to urge the actuator 1 towards its rest position while the actuator means 7 are returning to their rest position. More precisely, the resilient means 18 urge the actuator 1 into abutment against the fastener ring 19, and thus prevent the actuator 1 from being axially displaced with the actuator means 7 when said actuator means rise towards their rest position, e.g. by friction. The resilient means 18 can be made in any way, but advantageously the embodiments shown show two resilient blades 18 secured to the actuator 1 that are elastically deformed while the device is being actuated. Naturally, resilient means that are separate from the actuator could be envisaged.

Figure 2:
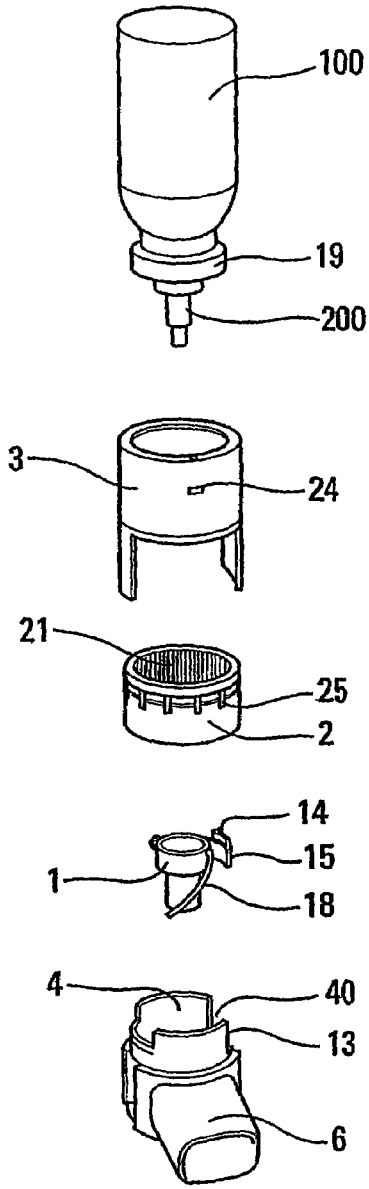
FIG. 2 is a view similar to the view in FIG. 1, showing a second embodiment of the present invention.
Figure 4:
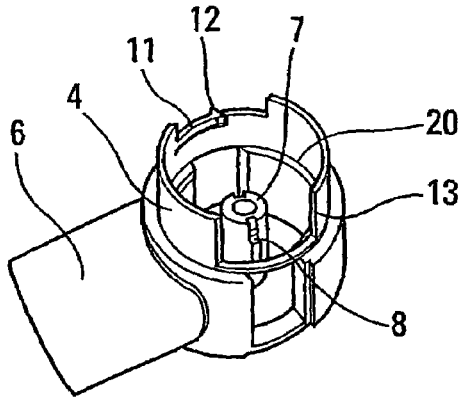
FIG. 4 is a view similar to the view in FIG. 3, showing a portion of the FIG. 2 device.
Figure 8:
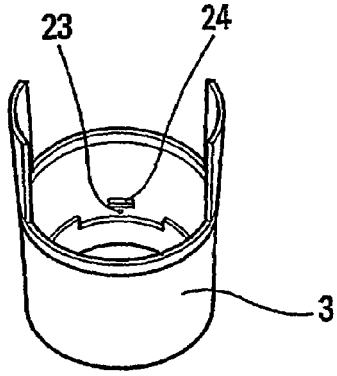
FIG. 8 is a diagrammatic perspective view of a cover element adapted for the second embodiment described in FIG. 2.

FIGS. 2, 4, and 8 describe elements of a second embodiment of the invention, in which the dispenser head 6 is not of the nasal type, but is a mouthpiece, and for which the dispenser member 200 can be a valve rather that a pump. The indicator operates in a manner that is very similar to that described above, and the difference resides in the fact that the head 6 does not include an insert 5, the actuator means 7 thus being formed directly in said head 6, as shown in FIG. 4. In addition, the cover element 3 includes lateral fins enabling it to be fastened onto the mouthpiece dispenser head 6, as shown in FIG. 2.

Although the present invention is described above with reference to two embodiments, it is clear that various modifications can be envisaged. Thus, for example, the shape and the length of the actuator member 8 and/or of the complementary actuator member 17 provided in the actuator means 7 can be modified so as to adapt the device to different pump or valve strokes and/or compensate for overall tolerances of the system. The actuator groove(s) 8 could be replaced by one or more corresponding ribs each co-operating with a respective suitable complementary actuator member 17. In addition, the guide groove(s) 22 could be replaced by one or more corresponding ribs co-operating with suitable complementary guide means 23. The actuator member(s) 8 can also be formed on a sleeve that could be separate from the insert 5, even when such an insert is used. The sleeve could be a portion of the head 6 or a separate component. The maximum number of doses that the system can count can also vary merely be adapting the number of teeth in the set of teeth 21 and/or the turns or fractions of turns of the guide means 22 of the indicator element 2. Said guide means 22 and/or said complementary guide means 23 can be of any shape providing it enables the indicator element 2 to be guided radially and/or vertically relative to the cover element 3. In addition, in the drawings, the cover element 3 includes a single guide projection 23 that co-operates with the guide groove 22, but the system could use a plurality of guide projections, or complementary guide means having shapes that are different from the shape shown.

Other modifications can also be envisaged by the person skilled in the art, without going beyond the ambit of the present invention, as defined by the accompanying claims.

The invention claimed is:

1. A dose indicator for a fluid dispenser device, said indicator comprising:

a body (4);

an actuator (1) that is mounted to turn relative to said body (4) about a first axis, and including drive means (14, 15); and a cylindrical indicator element (2) that is mounted to turn relative to said body (4) about a second axis and including a set of teeth (21) that co-operate with said drive means (14, 15) of said actuator (1) so as to turn each time the dispenser device is actuated, said indicator element (2) further including numeric and/or symbolic indicator means (25) so as to indicate to the user the number of doses that have been dispensed or that remain to be dispensed from said dispenser device;

said actuator (1) co-operating with actuator means (7) secured to said body (4), said actuator means (7) being displaced in translation each time the dispenser device is actuated, and co-operating with said actuator (1) so as to transform the translation of said actuator means (7) into said actuator (1) turning, said dose indicator being characterized in that one amongst the actuator (1) and the actuator means (7) includes at least one actuator member (8) that is partially oblique relative to the direction of displacement in translation of said actuator means (7), said at least one actuator member (8) co-operating with at least one complementary actuator member (17) provided on the other one amongst the actuator (1) and the actuator means (7), so that a displacement in translation of the actuator means (7) is transformed into said actuator (1) turning, and in that said actuator member (8) comprises an oblique portion that enables the dose to be counted, and a rectilinear portion disposed after said oblique portion in the actuation direction of said actuator means (7), said rectilinear portion enabling the actuation stroke of the device to be continued after the dose has been counted.

2. The dose indicator according to claim 1, in which said indicator element (2) is disposed around said actuator (1), said set of teeth (21) being formed on the inside peripheral wall of said indicator element (2).

3. The dose indicator according to claim 1, in which said first and second axes are identical.

4. The dose indicator according to claim 1, in which a cover element (3), secured to said body (4), is disposed around said indicator element (2), said cover element (3) including a window (24) in order to see said indicator means (25) of said indicator element (2).

5. The dose indicator according to claim 4, in which one amongst the indicator element (2) and the cover element (3) includes guide means (22) that co-operate with complementary guide means (23) provided on the other element (3, 2).

6. The dose indicator according to claim 5, in which said guide means (22) comprise at least one guide groove (22), and said complementary guide means comprise at least one guide projection (23).

7. The dose indicator according to claim 6, in which said guide groove (22), which may in particular be helical, winds around said indicator element (2) in a plurality of turns, or alternatively around said cover element (3), enabling the indicator to count a number of doses that is greater than the number of teeth provided in the set of teeth (21) of the indicator element (2).

8. The dose indicator according to claim 1, in which said oblique portion is provided at the start of the actuation stroke of the device.

9. The dose indicator according to claim 1, in which said at least one actuator member (8) is an actuator groove (8), and said at least one complementary actuator member (17) is an actuator projection (17).

10. The dose indicator according to claim 1, in which said drive means (14, 15) of the actuator comprise a flexible tab (15) supporting a drive projection (14) that co-operates with the teeth of the set of teeth (21) of the indicator element (2).

11. The dose indicator according to claim 10, in which said flexible tab (15) comprises a first flexible tab portion (15*a*), and a second flexible tab portion (15*b*), the first flexible tab portion (15*a*) supporting the drive projection (14), and the second flexible tab portion (15*b*) connecting said first flexible tab (15*a*) to said actuator (1).

12. The dose indicator according to claim 11, in which, in order to ensure a count at each actuation, and in order to compensate for manufacturing tolerances, the angle through which the actuator (1) turns is greater than the angle defined by a tooth in the set of teeth (21) of the indicator element (2), the body (4) including abutment means (13) to prevent the indicator element (2) from turning through more than one tooth in the set of teeth (21), the additional amount through which the actuator (1) turns being compensated by the second flexible-tab portion (15*b*) of the drive means (14, 15) flexing.

13. The dose indicator according to claim 1, in which said body (4) includes a wall portion (4) that is cylindrical, at least in part, and that is disposed between said actuator (1) and said indicator element (2), said wall portion having a cut-out (40) forming a passage for passing the drive means (14, 15) of the actuator (1) to the set of teeth (21) of the indicator element (2).

14. The dose indicator according to claim 12, in which an edge (13) of said cut-out (40) forms said abutment means (13).

15. The dose indicator according to claim 12, in which said body (4) includes anti-return means (11, 12) for the indicator element (2), said anti-return means preventing said element from turning in the direction opposite to the direction imparted thereto by the actuator (1).

16. The dose indicator according to claim 15, in which said anti-return means (11, 12) comprises a flexible tab (11) including an anti-return projection (12) that co-operates with said set of teeth (21).

17. The dose indicator according to claim 1, in which resilient means (18) are provided so as to urge said actuator (1) towards its rest position while the actuator means (7) are returning to their rest position.

18. The dose indicator according to claim 17, in which said resilient means (18) comprise at least one resilient blade (18) that is secured to said actuator (1), said at least one resilient blade (18) being elastically deformed while the device is being actuated.

19. A fluid dispenser device comprising: a reservoir (100) containing the fluid; a dispenser member (200), such as a pump or a valve; and a dispenser head (6) incorporating a dispenser orifice, said device being characterized in that it further comprises the dose indicator according to claim 1.

20. The fluid dispenser device according to claim 19, in which the body (4) is a portion of said head (6), said actuator means (7) being secured to said head (6).

21. The fluid dispenser device according to claim 19, in which said actuator means (7) are formed on an insert (5) that is inserted into said head (6) upstream from said dispenser orifice.

* * * * *